US006930613B2

(12) United States Patent
Gardner

(10) Patent No.: US 6,930,613 B2
(45) Date of Patent: Aug. 16, 2005

(54) ELECTRICAL INSTRUMENTS CIRCUITS

(76) Inventor: Robert Gardner, 3 Heol-y-Bryn, Barry, South Glamorgan (GB), CF62 8SY ( * ) Notice: Subject to any disclaimer, the term of this patent is extended or adjusted under 35 U.S.C. 154(b) by 321 days.

(21) Appl. No.: 10/239,242

(22) PCT Filed: Mar. 21, 2001

(86) PCT No.: PCT/GB01/01417

§ 371 (c)(1),
(2), (4) Date: Sep. 20, 2002

(87) PCT Pub. No.: WO01/71200

PCT Pub. Date: Sep. 27, 2001

(65) Prior Publication Data

US 2003/0039088 A1 Feb. 27, 2003

(30) Foreign Application Priority Data

Mar. 21, 2000 (GB) ..... 0006749
Mar. 21, 2000 (GB) ..... 0006750

(51) Int. Cl.[7] ..... G08B 21/00

(52) U.S. Cl. ..... 340/664; 340/500; 340/551; 340/641; 340/642; 340/643; 340/644; 340/657; 324/76.11; 324/522; 324/526

(58) Field of Search ..... 340/500, 551, 340/641–644, 657; 324/76.11, 522, 526

(56) References Cited

U.S. PATENT DOCUMENTS

| | | | | |
|---|---|---|---|---|
| 3,831,495 A | | 8/1974 | Arnold et al. | 91/459 |
| 4,099,032 A | * | 7/1978 | Roge et al. | 379/378 |
| 5,111,189 A | | 5/1992 | Yeh | 340/664 |
| 5,136,280 A | | 8/1992 | Heggli | 340/644 |
| 5,144,231 A | * | 9/1992 | Tenenbaum et al. | 324/164 |
| 5,382,836 A | | 1/1995 | Umemura | 307/127 |
| 5,453,923 A | * | 9/1995 | Scalais et al. | 363/53 |
| 5,600,715 A | * | 2/1997 | Bingel | 379/393 |
| 6,016,105 A | | 1/2000 | Schweitzer, Jr. | 340/664 |
| 6,177,875 B1 | | 1/2001 | Bolda | 438/228 |
| 6,392,612 B1 | * | 5/2002 | George | 345/20 |
| 6,424,136 B1 | * | 7/2002 | Gardner | 324/76.11 |

FOREIGN PATENT DOCUMENTS

| | | |
|---|---|---|
| DE | 38 44 936 | 8/1989 |
| FR | 2 535 928 | 5/1984 |
| JP | 2-304372 | 12/1990 |
| JP | 6-265585 | 9/1994 |

* cited by examiner

*Primary Examiner*—Anthony Knight
*Assistant Examiner*—Ronald D Hartman
(74) *Attorney, Agent, or Firm*—Young & Thompson

(57) ABSTRACT

A device representing a simple means of multiplying the functionality of wiring in point to point control circuits such that fault tolerant, fault reporting circuits can be constructed with less wire. The circuit can employ the wiring on a continuous basis by the use of AC and a series arrangement that may combine sensors and command loads on the same single wire loop. A bi-directional current detector with switchable impedance over each polarity can form the device. The detector may be equipped with an electrically isolated man-machine interface that communicates with light to achieve input-output functions. Command functions may be issued by changing the current level within the circuit over each polarity of current flow to series mounted remote loads that are polarized with diodes. The whole circuit can be in triplicate for high reliability and fault tolerance and use a common return wire.

14 Claims, 3 Drawing Sheets

ELECTRICAL INSTRUMENTS CIRCUITS

This invention relates to electrical instrument circuits, and in particular, although not exclusively to input/output interfaces and current indicators/detectors.

The fabrication of highly available instrument input/output (I/O) systems usually involves excessive complexity and a high cost of installation.

Another situation where the state of a circuit is monitored is for indicating or detecting an electrical current. Previously disclosed techniques for current indicators use the forward voltage drop across a series of semiconductor diodes, each diode having a characteristic 0.6 volts drop in its forward conduction mode. Multiple diodes wired in series are used to develop a voltage drop sufficient to match the forward conduction characteristics of an LED, sufficient to cause it to illuminate. These arrangements can be doubled, forming an indicator for both directions of current flow. As there is a substantial voltage drop with this arrangement, significant amounts of power will be dissipated, in proportion to the current flowing.

Embodiments of the present invention allow input and output signals to share the same wiring with economy and simplicity so that they may be installed in duplicate or triplicate circuits to achieve high levels of functional reliability and fault tolerance. This arrangement is intended to avoid the use of sensitive and complex "data bus" formats that communicate via coded signals to achieve wiring efficiencies.

Embodiments of the invention involve a selective bi-directional current indicator/detector and a selective bi-directional impedance controller that can form one module. This module can be located at the control centre and communicate current of either polarity to a remote field device. The remote field device may include up to two sensory switches, each polarised with diodes of opposite orientation and two loads with oppositely polarised diodes. The sensory switches and loads can be connected in various ways (such as mechanical linkage) to the same controlled entity, for example, a valve command fed to the loads could effect the sensory switches at a predetermined limit to indicate an open or closed status of the valve.

A circuit according to the invention can possess a high value resistive component that maintains a continuous monitoring current within the circuit throughout the AC cycle. The magnitude of this current is preferably sufficient to energise the current detector and allow it to monitor the position of the remote switches. If either switch becomes activated then only the current of one polarity may flow. The opposite switch may sense and control the other polarity. This monitoring current may be sufficient to energise the load devices. When a command is issued, the monitoring current device can be bypassed by a diode polarised switch such that only one or the other polarity of current limiting is bypassed. In this state sufficient current can flow in pulses at the supply frequency to energise the load of similar polarisation. Inductive loads may benefit from a flywheel diode wired across the coil that will maintain current in the coil between the AC cycles.

One object of the present invention is intended to provide a solution to the problem of detecting the state of switches.

According to the present invention there is provided a circuit for controlling the condition of a remote device, the circuit comprising an out and a return conductor between a command station and the device, a switch assembly in the region of the device through which current from the command station can pass, and an electromechanical assembly energisable through the switch assembly for changing the condition of said device, the state of the switch assembly being determined by the condition of the device, wherein the command station is adapted to deliver a low AC monitoring current to the out conductor, insufficient to operate the electromechanical assembly, and to determine the effect the state of the switch assembly has on that current, thereby producing an indication of the state of the switches therein or of a fault in the circuit, and wherein the command station is also adapted selectively to deliver a higher either positive or negative current to energise the electro-mechanical assembly in a manner determined by the state of the switch assembly, the condition of the device thereby being altered until it reaches a new condition causing the switch assembly to change its state.

Conveniently, the switch assembly has two switches in parallel, with differently polarised diodes in series with respective switches, the switches having a first condition with a path through one diode, a second condition with a path through the other diode, and a third condition with a path bypassing the diodes.

In one preferred form the electromechanical assembly has two solenoids in parallel, with differently polarised diodes in series therewith and with differently polarised diodes in parallel therewith, the solenoids being separately energisable one by the positive current and the other by the negative current, and each energised solenoid acting on the device to change its condition in the opposite sense to the change that would be caused by the other solenoid if energised.

The link between the device and said switches may be mechanical. It may be considered wise to have duplication, at least, of the circuit, with one device common to and controllable from each branch. There can be a corner return conductor serving each branch, which means that each extra branch requires just one out conductor between the command station and the local switch assembly.

This arrangement can achieve multiple functions over a two-wire circuit. By arranging a plurality of such circuits in parallel or series (and in some cases adding extra conductors and sensor switches for each extra circuit), fault tolerant and redundant circuits can be constructed at low cost. This can enhance the reliability of the controlled entity while being economical in control wire and avoiding the "bus type" system and its problematic failure modes.

Such a device can represent a simple means of multiplying the functionality of wiring in point to point control circuits such that fault tolerant, fault reporting circuits can be constructed with less wire. The circuit can employ the wiring on a continuous basis by the use of AC and a series arrangement that may combine sensors and command loads on the same single wire loop. A bi-directional current detector with switchable impedance over each polarity can form the device. The detector may be equipped with an electrically isolated man-machine interface that communicates with light to achieve input-output functions. Command functions may be issued by changing the current level within the circuit over each polarity of current flow to series mounted remote loads that are polarised with diodes. Status detection may be achieved via series mounted polarised remote sensor switches. The whole circuit can be in triplicate for high reliability and fault tolerance and use a common return wire.

According to a further aspect of the present invention, there is provided a circuit for indicating an electrical current, the circuit including:

a power diode that generates a volts drop suitable to power a parallel circuit, the parallel circuit including a transistor in series with a first inductor through its emitter collector circuit, and a second inductor connected to the base of the transistor and the first inductor, wherein the two inductors are magnetically connected via a ferrite core.

The circuit can form a low voltage switching oscillator when a sufficient potential difference appears across the diode in the forward mode and sufficient current is flowing for the inductor to store energy.

Initially current may flow into the base of the transistor via an inductor, switching the transistor "on". Current can then flow though the inductor and induce another current in the second inductor of opposite phase, thereby switching the transistor "off". This cycle may be repeated at high frequency and result in an elevated voltage between the transistor collector and emitter by virtue of the collapsing field within the inductor during the off transition of the transistor. Current indicating and detection elements may be connected across the collector-emitter of the transistor. These elements can include an indicating LED and/or a second LED with a series diode that may be part of an opto-coupler. (The diode may be required to match the forward voltage characteristics of an infrared LED (about 1 volt) with that of a visible LED (about 1.6 volt)). This arrangement is intended to ensure that both LEDs energise at substantially the same time.

An "element" can include one or more circuit components.

Preferably, the current indicating element includes one or more LEDs. The current indicating element may include an opto-isolator and/or a diode.

The circuits may further include a radio frequency interference reducing element. The interference reducing element may include a capacitor connected in parallel with the transient absorber. The interference reducing element can include shielding, which may be metallic.

The circuit may include substantially identical components to those described above inversely arranged so that both polarities of the current can be displayed.

The LEDs may be colour coded. The LEDs may be used for communication via optical channels and may use laser types.

According to a further aspect of the present invention there is provided a circuit for indicating an electrical current, the circuit including:

a transistor and a first inductor in series;

a power diode connected in parallel with the transistor and the first inductor;

a second inductor connected to the base of the transistor; and a current indicating element which is activated when a current passes through it, the current indicating element being connected in parallel with the transistor collector emitter such that when the transistor undergoes transition to an off-state, the voltage across the current indicating element is magnified by the collapsing magnetic field within the first inductor when the transistor switches off.

According to yet a further aspect of the present invention there is provided a circuit for indicating an electrical current, the circuit including:

a power source formed by a power diode forward volt drop;

a switching oscillator including a transistor, the oscillator connected in parallel with the power source, and a current indicating element connected in parallel with the switching oscillator such that when the switch undergoes transition to an off state, the voltage across the current indicating element is magnified by the voltage generated by the collapsing field within the inductor when the transistor switches off.

According to another aspect of the present invention there is provided a circuit for indicating an electrical current, the circuit including:

a power source formed by the power diode;

a switching oscillator including a transistor, the oscillator being connected in parallel with the power source, and a current indicating element connected in parallel with the switching oscillator such that when the switch undergoes transition to an off-state, the voltage across the current indicating element is magnified by the voltage between an emitter-collector of the transistor that is manifest by the collapsing magnetic field within the inductor.

A major advantage of circuits implemented in accordance with the present design is that of inherent low voltage drop and corresponding minimal power dissipation at higher current levels. Such circuits can make full use of miniaturised component techniques and occupy minimal board area and volume.

Embodiments of the invention represent devices that can convert current into light over a wide range. It may indicate the polarity of the current whilst also rendering isolated switched outputs to a machine that repeats this information. The resultant 4 bits of information can be used for coding and signalling the conditions present in AC or DC circuits with extreme versatility and reliability and without regard for voltage present. It can facilitate large reductions in wiring control circuits and ease the burden of weight in any application where current is flowing. It preferably operates from 0.4 Volts to 1 volt off the volt drop from a single pair of inversely connected diodes and so does not need any special power supply. It is especially suited to condition monitoring and could facilitate an optical transmitter of code with suitable intelligent modulation.

Whilst the invention has been described above, it extends to any inventive combination of the features set out above or in the following description.

The invention may be performed in various ways, and embodiments thereof will now be described by way of example only, reference being made to the accompanying drawings, in which.

Figure 2:
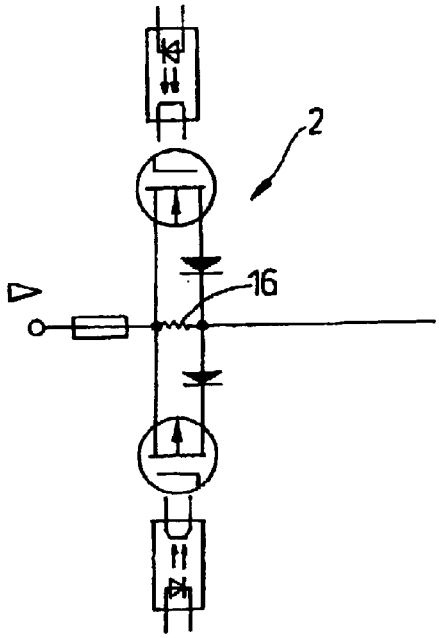
FIG. 2 illustrates schematically a first command device having a resistor which acts as a high impedance source to provide monitoring for current indication and detection. When a command is required, the resistance is bypassed via a diode and a solid state switch to render a low impedance path for solenoid drive currents over the respective half waves.
Figure 3:
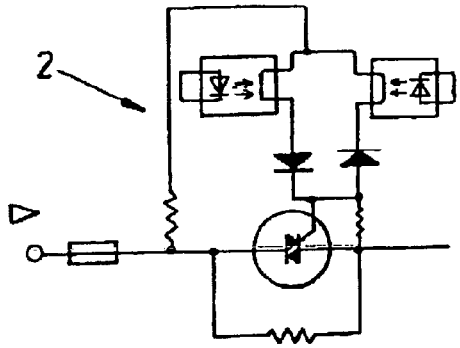
FIG. 3 illustrates schematically a second command device having photovoltaic photo emissive devices and optically triggered thyristors or triacs with zero crossing circuitry if required.
Figure 4:
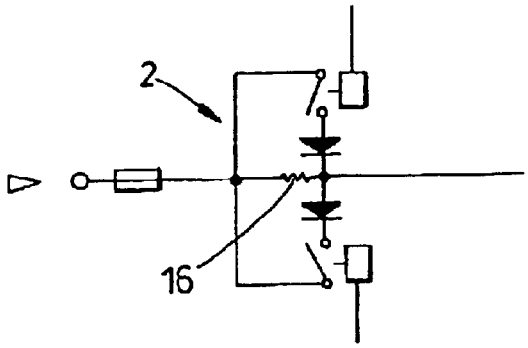
FIG. 4 illustrates schematically a third command device employing relays switched through polarising diodes if preferred.

Reference will first be made to the lower half of FIG. 1. The circuit has an AC power source 1 that feeds into a command device 2 and from there into a bi-directional current detector 3. The command device 2, can be in various different arrangements as shown in FIGS. 2, 3 and 4, as can be the current detector 3. The one shown has been described in WO 99/23497 and others described therein may also be suitable. From the current detector the circuit continues to a remote point where the controlled device is located, and passes through a dual polarised switch assembly. This has limit switches 4 and 5 in parallel, each with a diode 6 and 7 respectively in series and with a bridge 8 to enable those diodes to be bypassed in one slate of the switches. Beyond this assembly the circuit continues to solenoid valves 9 and 10 oppositely polarised by diodes 11 and 12 and with further diodes 13 and 14 in parallel therewith, these being opposed to the respective diodes 11 and 12. From the solenoid valves the circuit is completed by a common return conductor 15 back to the power source.

The command device 2 has a high value resistor 16 that can pass AC current of low magnitude on a continuous basis throughout the circuit. This current is monitored by the current detector 3 which returns information as to the position of the remote limit switches 4 and 5. The switches are mechanically linked to the position of an actuating device, in this example represented by a hydraulic ram 17, with fully open, fully closed and intermediate positions. Subject to the position of this ram the switches will pass four bits of information.

1. Ram Position open—Positive current
2. Ram Intermediate—Positive and Negative current
3. Ram Position closed—Negative current
4. Fault in circuit—zero current The current passes through one or both solenoids of valves 9 and 10 and back to the power source via the common return 15. This level of current is insufficient to energise either solenoid valve and provides a monitoring function only.

In order to energise either solenoid valve 9 and 10 the command device 2 is equipped with polarised solid state switches or equivalent devices that can selectively bypass the high resistance of the current control device. Selecting either of these switches allows either positive or negative current of increased magnitude to flow in the circuit, subject to the position of the switches 4 and 5. The level of this current is sufficient to energise either solenoid selectively and this causes the actuating device 17 to move towards its fully open or fully closed position. During this movement the switches 4 and 5 are in the position shown, bypassing the associated diodes 6 and 7 via bridge 8. Once an extreme position is achieved, for example the open one, the switch 4 breaks the circuit, its associated diode 6 blocks the alternative route for the current, and so the solenoid de-energises. But that switch 4 can pass current of the opposite polarity if reversal of the device 17 is initiated. The corresponding action takes place when the device 17 closes.

Figure 1:
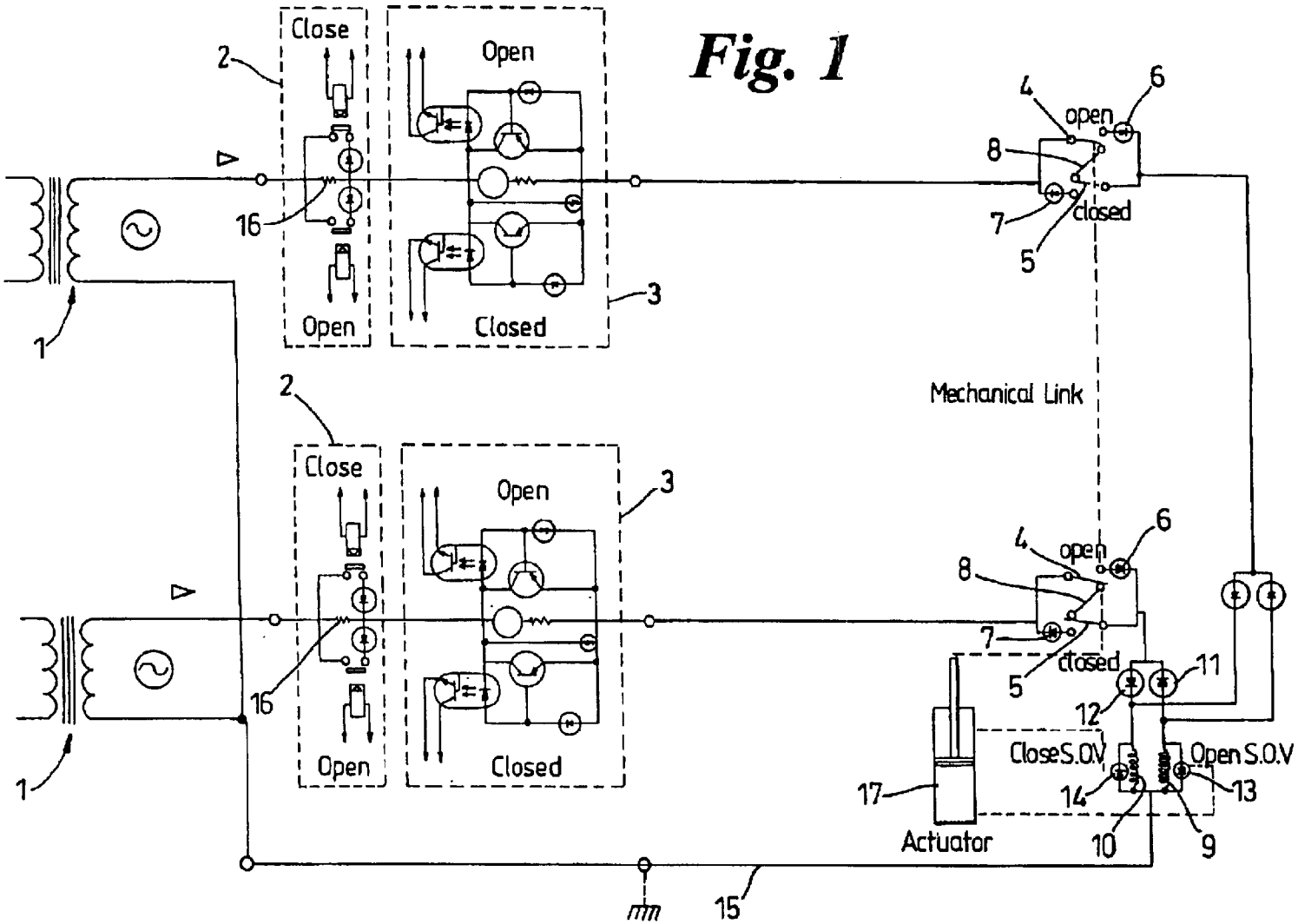
FIG. 1 illustrates schematically an input/output interface circuit according to a specific embodiment. The circuit receives an input via a command circuit such as those shown in FIGS. 2, 3 or 4.

The upper half of FIG. 1 is a duplication of the lower half, except for the device 17. It will be seen that this can have dual control, and indeed the circuit could be replicated again and again, to give multiple control but each extra circuit only requires one wire from its current detector 3 to the associated switch assembly, the return 15 being common to all. This failure or a fault in one circuit is not critical, and another circuit can take over.

With this arrangement full control and positional detection of an actuating device can be achieved with the minimum wiring. Installing this arrangement in plural while sharing the common return wire achieves a system of control that is highly available as well as fault tolerant. Significant economies are achieved on installation costs and plant can be more productive.

Figure 5:
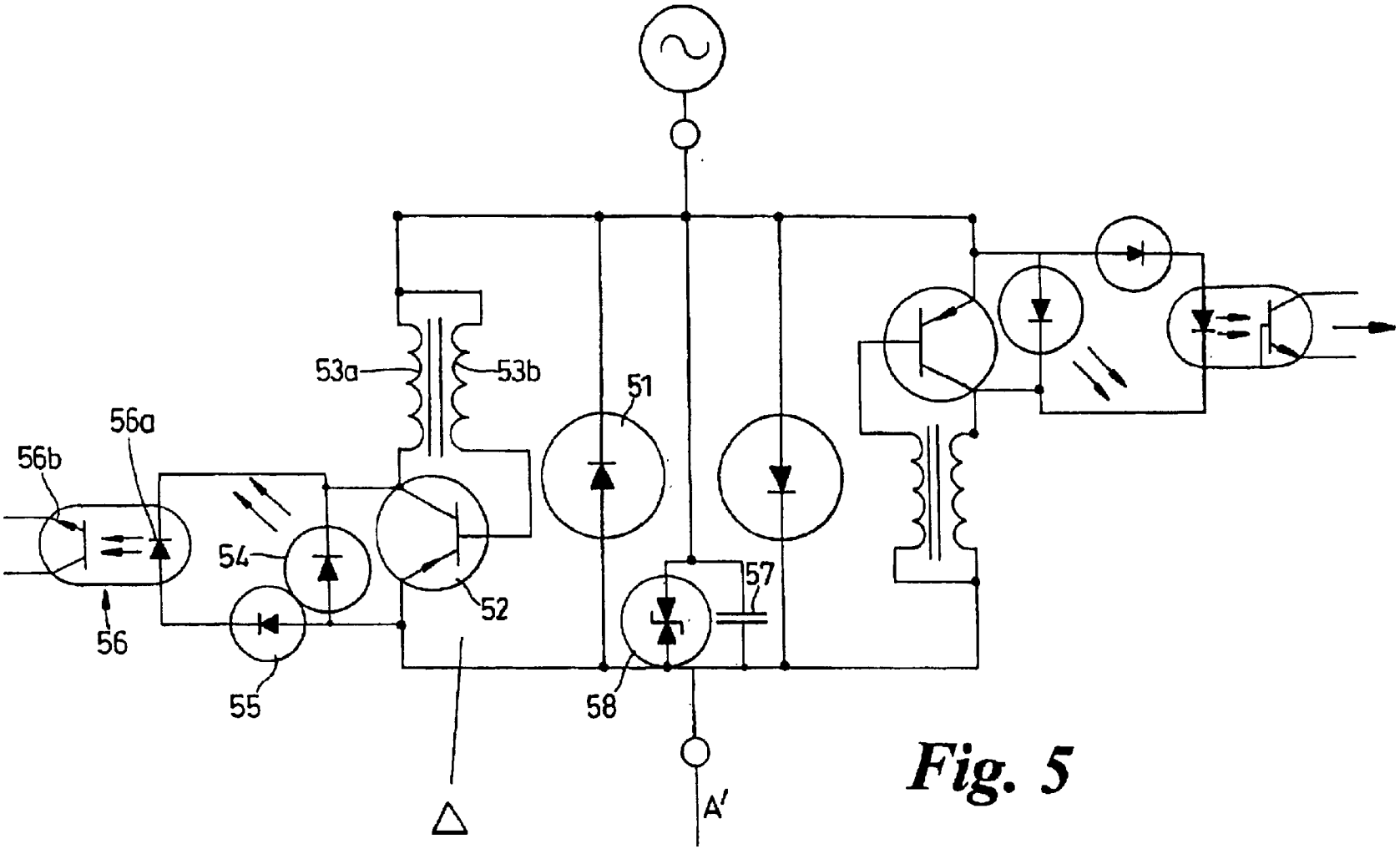
FIG. 5 illustrates schematically an electrical current detector for a circuit.

Referring to FIG. 5, a circuit with a current detector is shown. To aid the understanding of this device only substantially one half of the circuit (the half to the left of line A–A' in FIG. 5) will be described as the arrangement is intended to be doubled in an inverse fashion so that both polarities of current can be displayed. The circuit can be utilised in part, if so required, for a DC circuit.

In this arrangement the power required to energise the LED is developed across a single power diode 51. An inductor 53*a* in series with the collector-emitter of a transistor 52 co-operates with a suitable second inductor 53*b* wired to the base of the transistor, forming a transformer. The first and second inductors are magnetically coupled via a ferrite core. The second inductor serves both to bias the base of the transistor to "on" and to provide regenerative feedback from the first inductor. The circuit ultimately forms a switching oscillator.

The actions of this switching circuit serve to magnify the voltage across the LED 54 by the voltage between the collector-emitter terminals of the transistor 52 as it undergoes transition to the "off" state, by virtue of the collapsing magnetic field within the inductor. Added to this increased voltage is the 0.6 v developed across the power diode 51. The magnitude of this total voltage is sufficient to energise one or a plurality of LED's.

In the embodiment shown there is a visible LED 54, and another LED 56*a* that is part of an opto-isolator which, with a further diode 55, serves to match the forward voltage characteristics of the LED 54. The LED 56*a*, within the opto-isolator 56, influences a semiconductor 56*b* into conduction when LED 56*a* is radiating to mimic LED 54.

The configuration of the LED's is subject to various arrangements, including colour coding, subject to the requirements of the device. They may serve as a means of communication via optical means to a number of applications. Semiconductor laser diodes can replace the LEDs and can be modulated with data using conventional techniques. The frequency of the oscillator may be controlled by a piezo-electric device which will stimulate a specific carrier frequency for these communications.

The inclusion of a capacitor 57 across the diode 58 serves to minimise radio frequency interference.

It should be understood that the light output of the LED will oscillate at a period governed by the switching frequency, and so, depending on the application, it may be required that a Miller integrator be included as part of the opto-coupler transistor base circuit in line with normal practice.

In high current applications, a current transformer can power this circuit and provide further isolation.

The circuits described above can be used in conjunction with the arrangements shown in the applicant's co-pending international patent publication WO 99/23497.

It may be concluded that this circuit in its singular form represents an arrangement of relatively low reliability. This may be because so many elements are wired in series. Any one failure can render the control loop inoperative, but when one considers that the circuit can be in duplicate or triplicate and that faults can be interrupted as they happen (i.e. no current condition) one can realise that this circuit can represent high reliability and fault tolerance.

What is claimed is:

1. A circuit for indicating an electrical current, the circuit including:

a transistor and a first inductor in series;

a power diode connected in parallel with the transistor and the first inductor;

a second inductor connected to the base of the transistor; and a current indicating element which is activated when a current passes through it, the current indicating element being connected in parallel with the transistor collector emitter such that when the transistor undergoes transition to an off-state, the voltage across the current indicating element is magnified by the collapsing magnetic field within the first inductor when the transistor switches off.

2. A circuit according to claim 1, wherein the current indicating element includes an opto-isolator.

3. A circuit according to claim 2, wherein the current indicating element includes one or more LEDs.

4. A circuit according to claim 1, wherein the current indicating element includes a diode.

5. A circuit according to claim 4, wherein the interference reducing element includes shielding.

6. A circuit according to claim 5, wherein the shielding is metallic.

7. A circuit according to claim 1 wherein the two inductors are magnetically coupled via a ferrite core.

8. A circuit according to claim 1, further including a radio frequency interfering element.

9. A circuit according to claim 8, wherein the interference reducing element includes a capacitor.

10. A circuit according to claim 1, wherein the one or more LEDs are colour coded.

11. A circuit according to claim 1, wherein the one or more LEDs are used for communication via optical channels.

12. A circuit for indicating an electrical current, the circuit including:

a power source formed by a power diode;

a switching oscillator including a transistor, the oscillator being connected in parallel with the power source, and a current indicating element connected in parallel with the switching oscillator such that when the switch undergoes transition to an off-state, the voltage across the current indicating element is magnified by the voltage between an emitter-collector of the transistor that is manifest by the collapsing magnetic field within a first inductor.

13. A circuit according to claim 12, wherein the power source is developed across a power diode.

14. A circuit for indicating an electrical current, the circuit including:

a power diode that generates a volts drop suitable to power a parallel circuit, the parallel circuit including a transistor in series with a first inductor through its emitter collector circuit, and a second inductor connected to the base of the transistor and the first inductor, wherein the two inductors are magnetically connected via a ferrite core.

* * * * *